United States Patent [19]

Pearl

[11] Patent Number: 4,462,292

[45] Date of Patent: Jul. 31, 1984

[54] APPARATUS FOR CUTTING AND NOTCHING SHEET MATERIAL

[75] Inventor: David R. Pearl, West Hartford, Conn.

[73] Assignee: Gerber Garment Technology, Inc., South Windsor, Conn.

[21] Appl. No.: 388,229

[22] Filed: Jun. 14, 1982

[51] Int. Cl.[3] ..... D06H 702

[52] U.S. Cl. ..... 83/471.2; 83/71; 83/668; 83/692; 83/925 CC

[58] Field of Search ..... 83/863, 425.1, 302, 83/549, 667, 668, 925 CC, 921, 71, 692, 471.2, 337

[56] References Cited

U.S. PATENT DOCUMENTS

| | | | |
|---|---|---|---|
| 171,949 | 1/1876 | New et al. | 83/302 |
| 1,244,654 | 10/1917 | Spiegel | 83/302 |
| 1,986,074 | 1/1935 | Spang | 83/863 |
| 2,618,334 | 11/1952 | Cobb | 83/863 |
| 2,676,657 | 4/1954 | Weber et al. | 83/302 |
| 3,120,777 | 2/1964 | Genin | 83/863 |
| 3,771,402 | 11/1973 | Bernier | 83/668 |
| 4,171,657 | 10/1979 | Halberschmidt et al. | 83/925 CC |
| 4,254,601 | 3/1981 | Prager et al. | 83/337 |
| 4,362,077 | 12/1982 | Gerber | 83/925 CC |
| 4,373,412 | 2/1983 | Gerber et al. | 83/925 CC |
| 4,401,001 | 8/1983 | Gerber et al. | 83/483 |

FOREIGN PATENT DOCUMENTS

| | | | |
|---|---|---|---|
| 538035 | 7/1959 | Belgium | 83/921 |
| 2508160 | 8/1975 | Fed. Rep. of Germany | 83/425.1 |

*Primary Examiner*—Frank T. Yost
*Assistant Examiner*—Hien H. Phan
*Attorney, Agent, or Firm*—McCormick, Paulding and Huber

[57] ABSTRACT

A cutting apparatus includes a cutting tool in the form of a cutting wheel which rolls along a cutting path in cutting engagement with sheet material spread over a support surface. A second cutting tool is mounted adjacent the cutting wheel for notching the material along the path. The apparatus also includes actuator for moving the notching tool toward and away from the support surface to effect a notch. With the cutting tools mounted adjacent one another, a notch may be effected in the material as the cutting wheel moves along a cutting path.

12 Claims, 7 Drawing Figures

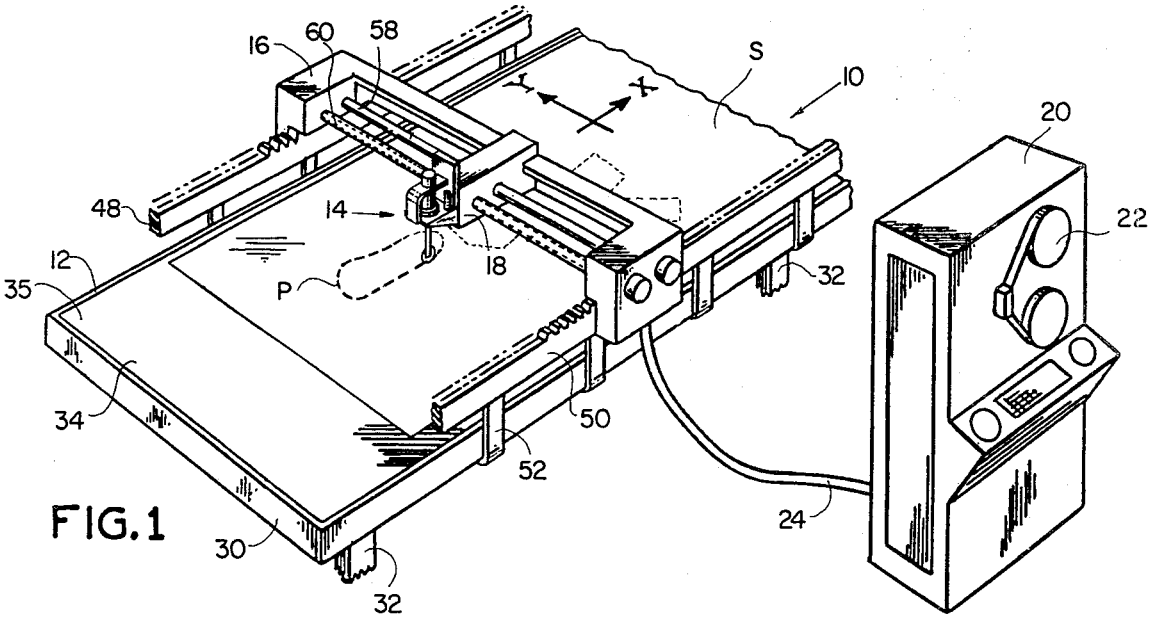
FIG. 1
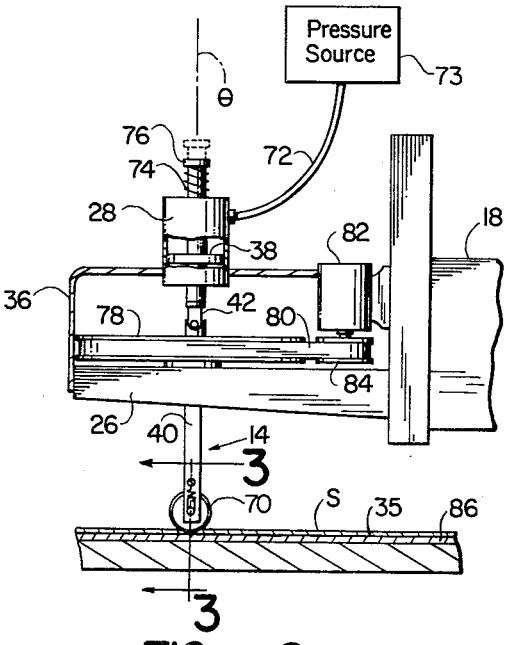
FIG. 2
FIG. 3
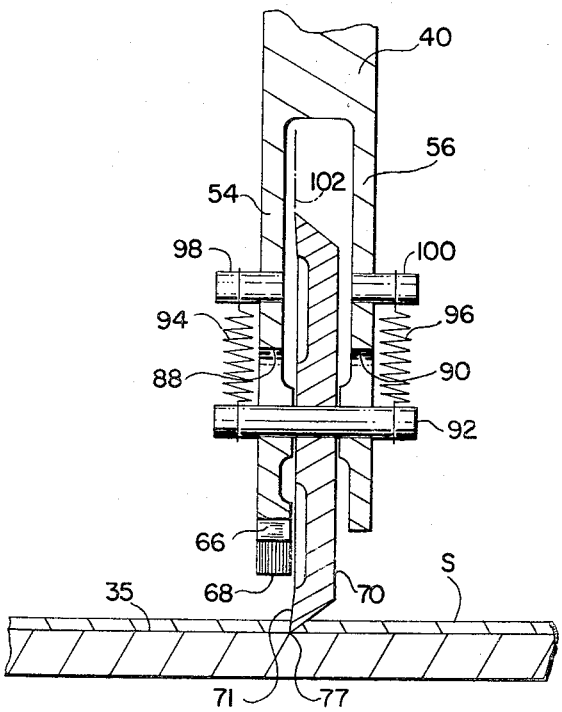

APPARATUS FOR CUTTING AND NOTCHING SHEET MATERIAL

BACKGROUND OF THE INVENTION

This invention relates to an apparatus for cutting and notching sheet material, and deals more particularly with a cutting head having a rotary cutting tool for cutting limp sheet material along a cutting path and a second cutting tool for forming notches in the sheet material adjacent the cutting path.

It is known that limp sheet material spread in a single or low-ply arrangement over a hard, smooth support surface can be cut by a rotary cutting wheel as the wheel is pressed against and rolled across the surface of the sheet material. The cutting operation of the material is effected by the partial slicing and partial crushing action between the periphery of the wheel and the support surface. A rotary wheel and hard support surface combination is utilized in the apparatus described in U.S. Pat. No. 4,373,412, having the same assignee as the present invention.

In cutting pattern pieces from sheet material, it is often desired to produce marking or index notches at various points along the principal or desired line of cut, these marking notches being later used, for example, to align various pattern pieces relative to one another in preparation for a sewing operation or the like. Generally the marking notches are relatively short slits which are cut in the material perpendicular to the principal line of cut or edge of a pattern piece.

In the past marking notches have usually been cut by lifting, rotating and lowering the cutting tool to bring the tool into proper orientation for cutting before the tool is moved inwardly of the piece beyond the principal line of cut to produce the notch. The notch may be cut immediately upon reaching the notch point or by cutting along the principal line of cut past the notch point and later returning to cut the notch. Either procedure, however, involves a substantial amount of maneuvering of the cutting tool and a substantial consumption of time.

It has been suggested in U.S. Pat. No. 3,766,813 that the tool lifting and lowering steps may be eliminated. However, when the cutting tool is a cutting wheel, the segment of the wheel periphery buried in the sheet material cannot be turned without twisting the material surrounding the wheel. Additionally, the sharp peripheral cutting edge of the segment tends to produce significant gouges in a soft underlying support surface.

A general object of this invention, therefore, is to provide an improved apparatus for cutting and notching sheet material whereby the time required for cutting notches is substantially reduced.

A more specific object of the invention is to provide an apparatus for cutting notches substantially "on the fly" as a rotary cutting blade is moved along a principal line of cut and a second cutting tool in the apparatus moves into and out of cutting engagement with the sheet material along the line of cut to thereby form notches at desired locations.

SUMMARY OF THE INVENTION

This invention resides in an apparatus for cutting limp sheet material along a cutting path with a rotary cutting wheel which is pressed against and rolled across the surface of the sheet material and for notching the sheet material along the cutting path with a second cutting tool which plunges into and out of cutting engagement with the sheet material adjacent the line of cut.

The apparatus comprises support means on which the sheet material is spread for cutting and a cutting head with a first and second cutting tool. The first cutting tool of the head is in the form of a cutting wheel which rolls on a surface of the support means in cutting engagement with the sheet material spread thereon, and the second cutting tool has a cutting edge for forming a notch in the sheet material as the cutting edge is moved into and out of the sheet material. Controlled translating means are connected with the cutting head and the support means for controllably moving the first and second cutting tools parallel to the support surface along a desired cutting path. Actuating means are connected to the second cutting tool for moving the cutting edge of the second cutting tool into and out of cutting relationship with the sheet material as the material is pressed between the cutting edge and the support surface.

The apparatus cuts and notches sheet material in a much shorter time than would be required by conventional cutting and notching devices since the maneuvering of cutting blades as required in conventional cutters is obviated. A specific feature of the invention is that notches can be cut by the second cutting tool as the first cutting tool is moved relative to the sheet material or, in other words, "on the fly".

BRIEF DESCRIPTION OF THE DRAWINGS

FIG. 1 is a fragmentary perspective view of a sheet material cutting apparatus in which this invention is embodied.

FIG. 2 is an elevational view of the cutting head of FIG. 1.

FIG. 3 is an enlarged sectional view as taken along the line 3—3 of FIG. 2 and illustrates the position of the notcher relative to the cutting wheel before a notching operation.

DETAILED DESCRIPTION OF THE PREFERRED EMBODIMENTS

Figure 4:
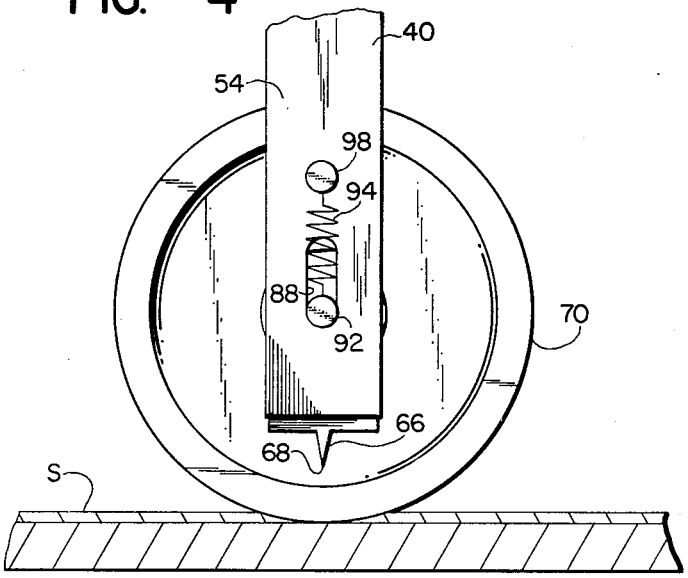
FIG. 4 is a side elevation view of the notcher and cutting wheel of FIGS. 2 and 3.

FIG. 1 illustrates an automated cutting system for cutting sheet material in which the present invention is embodied. The system, generally designated 10, is comprised of a cutting table 12, a cutting head 14 and a cutting head translating means comprised of an X-carriage 16 which moves over the cutting table 12 in the indicated X-direction, a Y-carriage 18 which is mounted to the X-carriage and moves relative to the table 12 and the X-carriage 16 in the indicated Y-direction and a control computer 20 connected to the carriages and the cutting head for controlling the motions of the head during the cutting operation. The control computer 20 derives program information from a memory tape 22 and develops cutting control signals in accordance with the information. The control signals are transmitted through a command cable 24 to the carriages 16 and 18 to cause the head 14 to be translated over the table 12 in cutting engagement with the sheet material S. From the program information defined by the memory tape 22, the computer guides the head along cutting paths P such as the peripheries of pattern pieces shown by dotted lines on the sheet material S.

The cutting table 12 has a frame 30 which rests on a plurality of table legs 32, 32 and a bed 34 defining the work surface 35 on which the sheet material S is spread in limited plies and generally in a single ply. The X-carriage 16 is supported above the cutting table 12 on a pair of racks 48 and 50 which extend longitudinally along the edge of the table in the X-direction and are held by brackets 52 projecting upwardly from the frame 30. Drive motors and pinions (not shown) within the carriage 16 engage the teeth of the racks 48 and 50 to drive the carriage 16 and the cutting head 14 back and forth over the table in the X-direction in accordance with the movement commands transmitted from the computer 20.

The Y-carriage 18 is suspended from the X-carriage 16 by means of a guide rail 58 and a lead screw 60 that extend in the Y-direction between the lateral ends of the X-carriage 16. The lead screw 60 is rotated by another drive motor (not shown) controlled from the computer 20 and threadably engages the Y-carriage 18 to position the carriage and cutting head in the Y-direction over the table. Composite motions of the X- and Y-carriages 16 and 18 permit the head 14 to be translated in any given direction over the work surface of the table 12 in cutting engagement with the sheet material to cut along the periphery of a pattern piece.

As shown in FIG. 2, the cutting head 14 is suspended from a platform 26 attached to the projecting end of the Y-carriage 18. The suspension includes a pneumatically or hydraulically operated actuator or cylinder 28 fixedly supported above the platform 26 by means of a frame 36. The actuator includes a piston and rod assembly 38 which is connected to a square drive rod 40 through a swivel connection 42. A cutting tool of the head 14 in the form of a cutting wheel 70, described in greater detail hereinafter, is supported at the lower end of the drive rod 40. A coil spring 74 is disposed around the upper end of the piston rod 76 and biases the piston toward its raised position within the cylinder.

The cylinder 28 is utilized to lower the cutting wheel 70 into cutting engagement with sheet material S on the table 12 as well as to establish a downward force which presses the sharp peripheral cutting edge of the wheel 70 against the support surface 35 and severs the sheet material during the course of a cutting operation. The support or work surface 35 defined by the bed 34 is hard enough to resist damage by the cutter as the cutting edge is pressed against the surface during a cutting operation. Pneumatic or hydraulic pressure is delivered from a pressure source 73 to the cylinder through a supply line 72 and operates on the upper surface of a piston 38 to push the piston downwardly against the force of the coil spring 74. The pressure source 73 delivers pressure to the cylinder sufficient in amount to overcome the force of the spring 74 and to lower the cutting wheel to the table surface. When pressure within the cylinder is relieved, the wheel and piston rod are biased upwardly to the phantom position by the spring 74. Thus, by controlling pressure within the cylinder, the cutting wheel can be brought into and out of engagement with sheet material on the cutting table.

In order to execute cutting along a path P shown in dotted lines in FIG. 1, the cutting wheel 70 must not only be translated over the table by the carriages 16 and 18, but also must be oriented in the direction of travel. Accordingly and as shown in FIG. 2, the square drive rod 40 is slidably received in a bushing centered in a toothed pulley 78 which is coupled by means of a drive belt 80 to another toothed pulley 84 which is, in turn, keyed to the shaft of $\theta$-drive motor 82. This arrangement permits the $\theta$-drive motor to orient the cutting wheel 70 in response to command signals derived from the control computer 20. The swivel connection 42 allows the drive rod to be rotated independently of the piston 38, but lifts and lowers the rod through the pulley 78.

As shown in FIGS. 2 through 5, the support surface 35 of the cutting table 12 (FIG. 1) is defined by the upper surface of a hard plate 86 which in one embodiment is made from sheet steel. Other types of materials which are suitable for the plate include aluminum, fiberboard, a hard plastic or other synthetic materials. Due to the downward forces applied by the piston 38, the sharp peripheral cutting edge of the wheel 70 slightly scores the surface of the sheet material as the wheel is translated in cutting engagement with the sheet material S spread on the surface. The downward force is selected to allow a limited scoring of the support surface 35 for complete severance of the material along the cutting path, but the force is sufficiently limited so that the depth of any scoring does not interfere with subsequent cutting and does not rapidly dull the peripheral cutting edge of the wheel 70. To preserve the cutting edge, the wheel is preferably made of a hard steel or carbide material.

Figure 5:
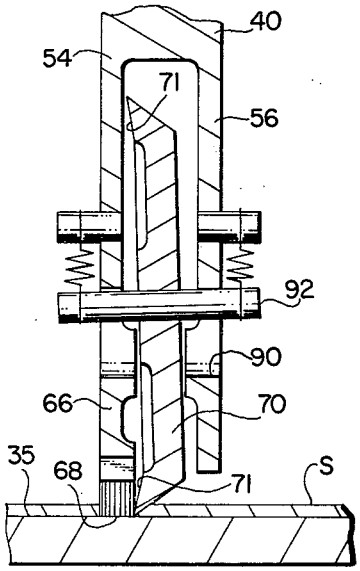
FIG. 5 is an enlarged sectional view of the cutting tool as in FIG. 3 and illustrates the position of the notcher relative to the cutting wheel when the notcher is cutting a notch.

In accordance with the present invention and with reference to FIGS. 3 through 5, the cutting head has, in addition to the cutting wheel 70 which constitutes a first cutting tool, a second cutting tool in the form of a notcher 66. Both cutting tools are supported on the underside of the cutting head by the drive rod 40. The drive rod, constituting a tool-supporting member, has a bifurcated lower end from which both the cutting wheel 70 and notcher 66 are suspended. The notcher 66 is in the form of a straight-edged blade fixedly attached to a branch 54 of the drive rod bifurcation with its cutting edge 68 oriented perpendicular to the wheel 70 and facing the supporting surface 35. Each branch 54, 56 of the drive rod bifurcation defines an elongated slot 88, 90 extending generally perpendicular to the support surface 35 and aligned with the slot of the other branch. Positioned between the branches is the cutting wheel 70 with its axle 92 loosely received within the slots. Up and down movement of the wheel relative to the drive rod is thereby permitted. The cutting wheel axle is continually biased toward the end of the slots nearest the support surface 35 by compression springs 94, 96 connected between the end portions of the cutting wheel axle 92 and pins 98, 100 fixed to the drive rod bifurcation. The spring force applied when the springs are extended, as shown in FIG. 3, is slightly greater than the downward detrusive force required to effect complete severance of the sheet material S between the wheel 70 and the support surface 35.

Until a notch is desired, the pressure within the actuator cylinder 28 is maintained at a value which supplies a downward force of the cutting wheel 70 sufficient to sever the material between the wheel edge and the support surface as the wheel is translated along the cutting path. While this material-severing pressure is maintained, the cutting edge of the notcher is spaced above the sheet material and the springs 94 and 96 are extended as shown in FIG. 3. When the wheel reaches a cutting path location at which a notch is desired, the control computer 20, in controlling relationship with the pressure source 73, suddenly increases the pressure within the cylinder 28 to move the drive rod and notcher toward the support surface. As the notcher is moved downwardly, the springs 94 and 96 compress, as shown in FIG. 5, and allow the drive rod to move relative to the cutting wheel as the wheel axle 92 moves within the bifurcation slots 88 and 90. The springs 94 and 96 continuously bias the wheel toward the support surface so that the wheel is kept in cutting relationship with the material throughout a notching operation. A notch is cut when the notcher strikes the table with sufficient force to sever the material between its cutting edge 68 and the support surface. After the notcher strikes the surface, the cylinder pressure is relieved by suitable means to the value maintained before the notching operation so that the notcher is lifted by the springs 74, 94, 96 to its FIG. 3 position spaced above the support surface.

Referring to FIGS. 3 and 5, the cutting wheel 70 has, in a preferred embodiment, a concave axial side 71 facing the notcher and a cutting edge 77 defined along the periphery of the concave side. The wheel edge 77 lies in a plane 102 offset to the concave side of the wheel. The notcher 66, when spaced above the sheet material as shown in FIG. 3, has a portion of its cutting edge 68 positioned between the plane 102 of the wheel edge 77 and the concave axial side 71. As the cutting edge 68 of the notcher approaches the support surface 35 in a notching operation, the edge 68 slidably engages the concave surface 71 and pushes the wheel edge 77 to a skewed position, as shown in FIG. 5, slightly offset from the cutting path. When the wheel is pushed to the condition in FIG. 5, the right end portion of its axle 92 is allowed to rise in its respective bifurcation slot 90 to a position slightly higher than that of the left end portion of its axle. When the drive rod lifts the notcher away from the support surface 35, the springs 94 and 96 extend from their FIG. 5 compressed condition and return the wheel axle into engagement with the base of the bifurcation slots 88 and 90 and into alignment with the cutting path. As will be noted, the notcher and springs 94, 96 cooperate as camming mechanisms to move the wheel between its FIG. 3 condition and its FIG. 5 condition as the notcher moves toward and away from the support surface.

As shown in FIG. 5, the cutting edge 68 of the notcher 66 contacts the cutting edge 77 of the wheel 70 in the offset condition when both tools are in cutting relationship with the material. This contact between the cutting edges insures that a notch effected by the notcher extends to the edge of the pattern piece.

Figure 6:
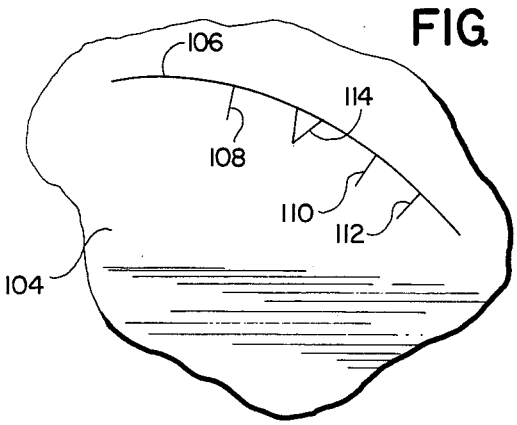
FIG. 6 is a plan view of sheet material cut and notched along a cutting path.

The notcher 66 has been described as having a single straight edge for forming notches of single slits extending perpendicular to the cutting path. Examples of such notches are indicated at 108, 110, and 112 along the cutting path 106 in the sheet material 104 of FIG. 6. It will be understood, however, that in accordance with the broader aspects of this invention, other types of notchers may be used instead of one with a single straight edge. A different type of notcher may be required to produce a different type of notch. If a V-shaped notch, such as the one indicated at 114 in FIG. 6, is desired, a notcher with a V-shaped cutting edge may be employed.

Figure 7:
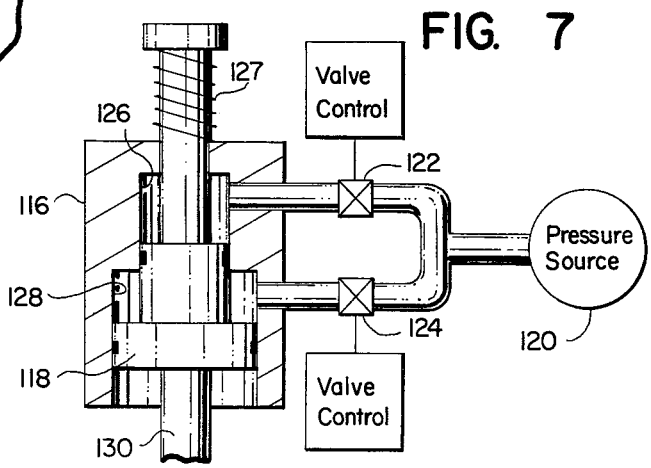
FIG. 7 illustrates an alternative notcher and cutting wheel actuating mechanism.

An alternative to the piston-cylinder arrangement of FIG. 2 is schematically illustrated in FIG. 7. The cylinder 116 is used in place of the cylinder 28 of FIG. 2 to position the cutting wheel in cutting relationship with the sheet material as well as to establish the downward force of the drive rod required to notch the material. The cylinder 116 defines two internal variable volume chambers 126, 128, each partially defined by one of two upwardly facing areas of a piston 118. The variable chambers decrease or increase in size as the piston, with drive rod 130 attached, moves up or down in the cylinder. A coil spring 127 is disposed around the upper end of the drive rod 130 which biases the piston 118 and drive rod 130 upwardly. The cutting wheel and notcher are connected at the lower end of the drive rod so that the wheel and notcher move toward and away from the support surface as the piston moves within the cylinder. Valves 122 and 124 are interposed between the pressure source 120 and the cylinder chambers 126 and 128, respectively, for closing off the pressure from the source 120 and venting the cylinder chambers 126, 128. With the valves 122, 124 closed and the chambers 126, 128 vented, the coil spring 127 urges the drive rod to a raised condition at which the cutting wheel and notcher are both spaced above the support surface. With one valve 122 open, pneumatic or hydraulic pressure is delivered from the pressure source 120 to one cylinder chamber 126 and acts against the piston 118 to overcome the coil spring force and to urge the cutting wheel downwardly against the table. With only one valve 122 open, however, the net downward force of the wheel is sufficient to sever the material between the surface and cutting edge of the wheel while the cutting edge of the notcher is spaced above the support surface as shown in FIG. 3. To effect a notch, both valves 122 and 124 are opened so that the pressure from the source 120 acts over both upwardly-facing surfaces of the piston 118 and moves the notcher toward and into the sheet material with sufficient force to sever the material between the cutting edge of the notcher and the support surface. Once the notcher has severed the material, one valve 124 is closed, the pressure within the associated cylinder chamber 128 is relieved, and the coil spring 127 raises the notcher to its FIG. 3 position spaced above the support surface.

A significant feature of the apparatus of this invention is that a notch can be effected while the cutting wheel 70 is moving along the cutting path, or "on the fly". The progress of the cutting wheel along a cutting path is slightly hampered by the momentary skewing of the cutting wheel, but a substantial amount of notching time is saved by the apparatus over prior art cutting and notching processes which require substantial maneuvering of a cutting wheel to effect a notch.

Although the embodiment described herein having a notcher with a single straight edge is particularly suited for forming notches perpendicular to the cutting path, the same embodiment may be utilized to form V-shaped notches. To form a V-shaped notch with a straight single-edged notcher, the control computer 20 would be programmed to actuate the notcher once after slightly pivoting the wheel in one direction about a vertical axis, then moving the cutting wheel an incremental distance along the cutting path to another position, and then actuating the notcher again after slightly pivoting the wheel in a direction opposite the pivotal direction at its previous position. The straight notches intersect so that each notch forms a leg of a V-shaped notch. If a pattern piece requires both straight and V-shaped notches, an embodiment, as described, with the capacity to form two types of notches with the same notching tool, may be utilized to cut and notch the pattern piece with no changeover of the notching tool.

It will be understood that numerous modifications may be had to the embodiment of the invention described herein without departing from the spirit of the invention. For example, although the cutting wheel and notcher have been disclosed in the aforedescribed embodiment as being supported from a single drive rod or tool-supporting member in the cutting head, an alternative embodiment may include two independant tool-supporting members from which the wheel and notcher are respectively supported. Accordingly, the description is intended as illustration and not as limitation.

I claim:

1. Apparatus for cutting limp sheet material along a cutting path defined by a pattern piece and forming notches in the sheet material along the cutting path, comprising:

support means defining a support surface on which sheet material is spread for cutting;

a cutting head including a first cutting tool in the form of a cutting wheel rotatable about an axis extending generally parallel to the support surface and with a peripheral cutting edge which rolls on the support surface of the support means along a cutting path in cutting engagement with the sheet material spread on the surface, the head further including a second cutting tool in the form of a notcher mounted axially adjacent the wheel for movement toward and away from the support surface and movement with the cutting wheel along the cutting path, the notcher having a cutting edge for effecting a notch in the sheet material adjacent the location of the wheel along the cutting path as the notcher moves toward and away from the support surface and as the cutting edge of the notcher moves into and out of cutting relationship with the sheet material on the support surface;

controlled translating means connected with the cutting head and the support means for controllably moving the cutting wheel and notcher parallel to the support surface along a desired cutting path;

controlled rotating means also connected with the cutting head for turning the cutting wheel and the axially adjacent notcher jointly about an axis perpendicular to the support surface to enable the wheel and notcher to translate along a cutting path defined by a pattern piece; and actuating means connected to the notcher for moving the notcher toward and away from the support surface and the cutting edge of the notcher into and out of cutting relationship with the sheet material to effect a notch in the sheet material adjacent the cutting path of the wheel as the material is pressed between the cutting edge of the notcher and the support surface.

2. An apparatus as defined in claim 1 wherein the cutting head includes a tool-supporting member movable in the head toward and away from the support surface and to which the notcher is fixed and means connecting the cutting wheel to the tool-supporting member for movement of the member relative to the wheel as the notcher is moved toward and away from the support surface and the wheel remains in cutting relationship with the material on the surface.

3. An apparatus as defined in claim 2 wherein the means connecting the wheel to the tool-supporting member includes means acting between the cutting wheel and the tool-supporting member for biasing the wheel toward the support surface.

4. An apparatus as defined in claim 3 wherein the cutting wheel has an axle having two ends, each of the axle ends protruding from an opposite side of the wheel, the tool-supporting member includes a bifurcated portion, each branch of the bifurcated portion defining an elongated slot extending generally perpendicular to the support surface and aligning with and generally the same size as the slot of the other bifurcation, the cutting wheel is arranged between the branches with the axle ends loosely received in the slots, and the means for biasing the wheel toward the support surface includes a spring interposed between the tool-supporting member and the wheel axle to bias the wheel and axle toward the end of the slot nearest the support surface.

5. An apparatus as defined in claim 2 wherein the actuating means includes a piston and cylinder assembly, the cylinder being fixed within the cutting head, the tool-supporting member is attached to the piston and is movable toward and away from the support surface as the piston moves relative to the cylinder, and the actuating means further includes a spring connected and acting between the cylinder and piston and a pressure source connected to the piston and cylinder assembly for moving the notcher toward and away from the support surface between a first condition at which the cutting wheel is in cutting relationship with the sheet material while the notcher is spaced from the material and a second condition at which both the cutting wheel and notcher are in cutting relationship with the material.

6. An apparatus as defined in claim 5 wherein the piston and cylinder assembly defines two variable volume chambers and the actuating means further includes two supply lines separately connecting each variable volume chamber to the pressure source and valving means interposed in the supply lines for opening and closing the supply lines and thereby control the movement of the notcher between the first and second conditions.

7. An apparatus as defined in claim 1 wherein the cutting head includes a tool-supporting member from which the cutting wheel is supported, means supporting the wheel for limited movement between a first condition at which the cutting edge of the wheel aligns with the cutting path and a second condition at which the cutting edge is slightly offset to one side of the path, and camming means for moving the wheel between the first and second conditions as the notcher is moved toward and away from the support surface.

8. An apparatus as defined in claim 7, wherein the means supporting the wheel for limited movement includes a spring positioned between the tool-supporting member and the wheel for biasing the wheel from the second condition toward the first condition, the cutting wheel has a concave axial side and the peripheral cutting edge lies in a plane offset to the concave side of the wheel, and the notcher is mounted with a portion of its cutting edge between the cutting edge plane of the wheel and the concavity of the concave side whereby the notcher slidably engages the wheel as the notcher is moved toward and away from the support surface and cooperates with the positioned spring to move the wheel from the first condition to the second during notcher movement toward the support surface.

9. An apparatus as defined in claim 8 wherein the cutting wheel has an axle with end portions protruding from each side of the wheel, and the means supporting the cutting wheel for limited movement includes a bifurcated tool-supporting member having branches defining aligning slots loosely receiving the axle end portions of the cutting wheel arranged between the branches, each branch slot extending generally perpendicular to the support surface and generally having the same size as the slot of the other branch, and an additional biasing spring, each of the two springs being connected between the tool-supporting member and a respective axle end portion to bias the axle toward the end of the slot nearest the support surface.

10. An apparatus as defined in claim 1 wherein the cutting wheel is mounted for rotation within a plane, the cutting edge of the notcher is straight, and the notcher is mounted with its cutting edge generally perpendicular to the plane of the cutting wheel rotation.

11. An apparatus as defined in claim 1 wherein the cutting edge of the notcher is V-shaped and the notcher is mounted with its V-shaped cutting edge in a plane parallel to the support surface and with the V-shape opening toward the cutting wheel whereby movement of the notcher into and out of cutting relationship with the sheet material effects a V-shaped notch in the material adjacent the cutting path.

12. An apparatus as defined in claim 1 wherein the actuating means includes a piston and cylinder assembly, the cylinder being fixed within the cutting head, the notcher is attached to the piston and is movable toward and away from the support surface as the piston moves relative to the cylinder, and the actuating means further includes a spring interposed between the cutting head and notcher for biasing the notcher away from the support surface, a pressure source for increasing the cylinder pressure to overcome the force of the spring and move the notcher toward and into contact with the support surface, and means for relieving the cylinder pressure to allow the spring to move the notcher away from the surface.

* * * * *